US008047331B2

(12) United States Patent
Spicer

(10) Patent No.: US 8,047,331 B2
(45) Date of Patent: Nov. 1, 2011

(54) LADDER ATTACHMENT FOR HITCH

(76) Inventor: John W. Spicer, Bradenton, FL (US)

( * ) Notice: Subject to any disclaimer, the term of this patent is extended or adjusted under 35 U.S.C. 154(b) by 317 days.

(21) Appl. No.: 12/069,789

(22) Filed: Feb. 13, 2008

(65) Prior Publication Data

US 2009/0200111 A1 Aug. 13, 2009

(51) Int. Cl.
*E06C 5/00* (2006.01)

(52) U.S. Cl. ..... 182/127

(58) Field of Classification Search ..... 182/127
See application file for complete search history.

(56) References Cited

U.S. PATENT DOCUMENTS 3,731,947 A * 5/1973 Fontaine ..... 280/641
4,858,725 A * 8/1989 Griffin ..... 182/127
5,020,757 A * 6/1991 Sulecki et al. ..... 248/238
5,039,119 A * 8/1991 Baughman ..... 280/166
5,190,195 A * 3/1993 Fullhart et al. ..... 224/497
5,236,062 A * 8/1993 Laney ..... 182/127
5,730,345 A * 3/1998 Yeckley et al. ..... 224/505
6,045,102 A * 4/2000 Terenzoni ..... 248/238
6,234,510 B1 * 5/2001 Hammons ..... 280/477
6,276,698 B1 * 8/2001 Calandra ..... 280/19
6,357,779 B1 * 3/2002 Mok et al. ..... 280/478.1
6,386,573 B1 * 5/2002 Solomon ..... 280/504
6,523,730 B2 * 2/2003 Anderson ..... 224/324
7,021,645 B1 * 4/2006 Stettler ..... 280/491.4
7,111,765 B1 * 9/2006 Blakley ..... 224/506
7,168,521 B1 * 1/2007 Murray ..... 182/127
7,484,594 B1 * 2/2009 Feliciano et al. ..... 182/127
2002/0179369 A1 * 12/2002 Wallace ..... 182/63.1
2005/0189174 A1 * 9/2005 Stout ..... 182/127
2005/0252720 A1 * 11/2005 Chant et al. ..... 182/127

* cited by examiner

*Primary Examiner* — Katherine Mitchell
*Assistant Examiner* — Candace L Bradford
(74) *Attorney, Agent, or Firm* — Dorothy S. Morse

(57) ABSTRACT

An attachment (10) for operably mounting and supporting a ladder (12) comprises an angular frame (18, 20) adapted for receipt by a vehicular hitch (14). The frame (18, 20) includes crosspieces (26) adapted for receiving rungs of the ladder (12), which are releaseably connected together with fasteners (28). In the second embodiment, the fasteners (28') are captured on the frame (18', 20').

21 Claims, 8 Drawing Sheets

LADDER ATTACHMENT FOR HITCH

BACKGROUND ART

Various types of portable ladders have been used heretofore to facilitate access to elevated locations for construction or maintenance purposes. Such ladders are either self-supporting, such as step ladders, or non-self-supporting, such as straight or extension ladders. Straight ladders are available in various fixed lengths. Extension ladders are also available in various, adjustable lengths. Straight and extension ladders are best suited for use in situations where both ends can be supported on and against suitable surfaces for stability and safety purposes. All such ladders are available with different duty ratings, depending upon their intended use.

Of course, regardless of the type of ladder being used, it is important to have it securely supported for stability and safety purposes. Self-supporting step ladders require secure support only at their lower ends. However, straight and extension ladders must be securely supported at both ends. Proper placement and support are critical, especially with long ladders and the higher up workers go on them. Serious injuries can and do result from falling off ladders that move or slip from not being securely supported.

Professional contractors and maintenance workers typically carry several types of fixed and extension ladders for use in different situations, although this tends be duplicative and thus expensive.

However, there are many applications where ladders simply cannot be used safely, if at all. For example, stringing outdoor lights in tall shrubbery or trees in a yard during the holidays can be difficult and unsafe when there is inadequate support for one or both ends of a ladder, or when it is either too high to reach from the ladder. Scaffolding is heavy and too expensive and time consuming to use in such situations. Aerial ladders and hydraulic lift buckets or 'cherry pickers' can sometimes be used in such situations, but they tend to be even more expensive and may not be able to access the desired location without damaging the surrounding yard.

A need has thus arisen for an attachment for operably mounting and securely supporting a ladder directly on a vehicle hitch to facilitate access to elevated locations which would otherwise be inaccessible without using expensive scaffolding, aerial ladders and/or cherry pickers.

SUMMARY OF INVENTION

The present invention comprises a ladder attachment for a vehicular hitch which overcomes the foregoing and other difficulties associated with the prior art. In accordance with the invention there is provided a new and unique ladder attachment that is adapted for use with hitches, such as receiver hitches, on vehicles such as pick-up trucks, SUV's and the like. By means of the ladder attachment herein, a ladder can be removably attached to a vehicular hitch so that the vehicle in effect provides the necessary stability and support while using the ladder. Either a fixed or extension ladder can be used with the attachment herein.

BRIEF DESCRIPTION OF DRAWING

A better understanding of the invention can be had by reference to the following Detailed Description in conjunction with the accompanying Drawing, wherein.

DETAILED DESCRIPTION

Figure 1:
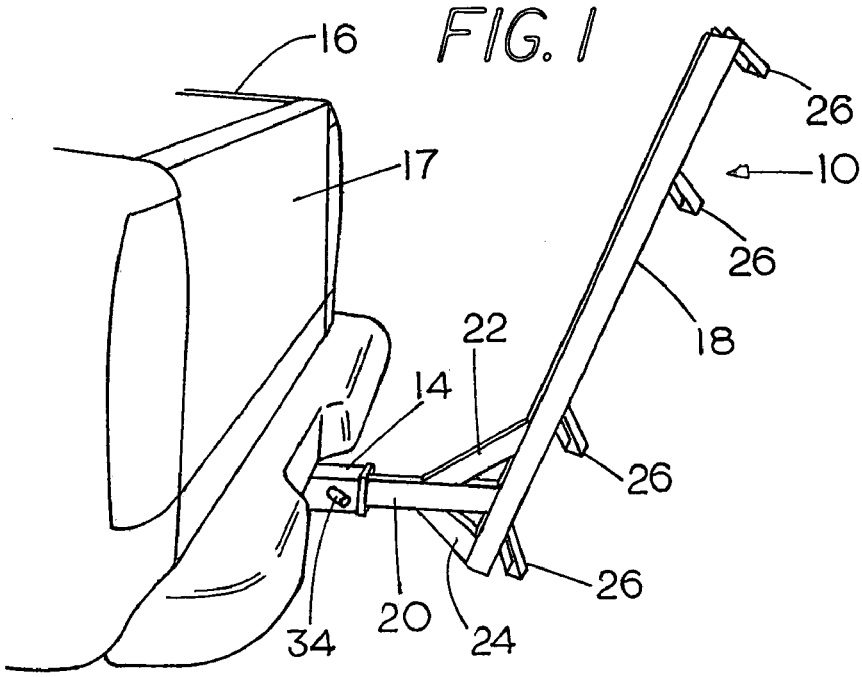
FIG. 1 is a side view way of a ladder attachment incorporating a first embodiment of the invention, secured to the rear hitch of a pick up truck.
Figure 2:
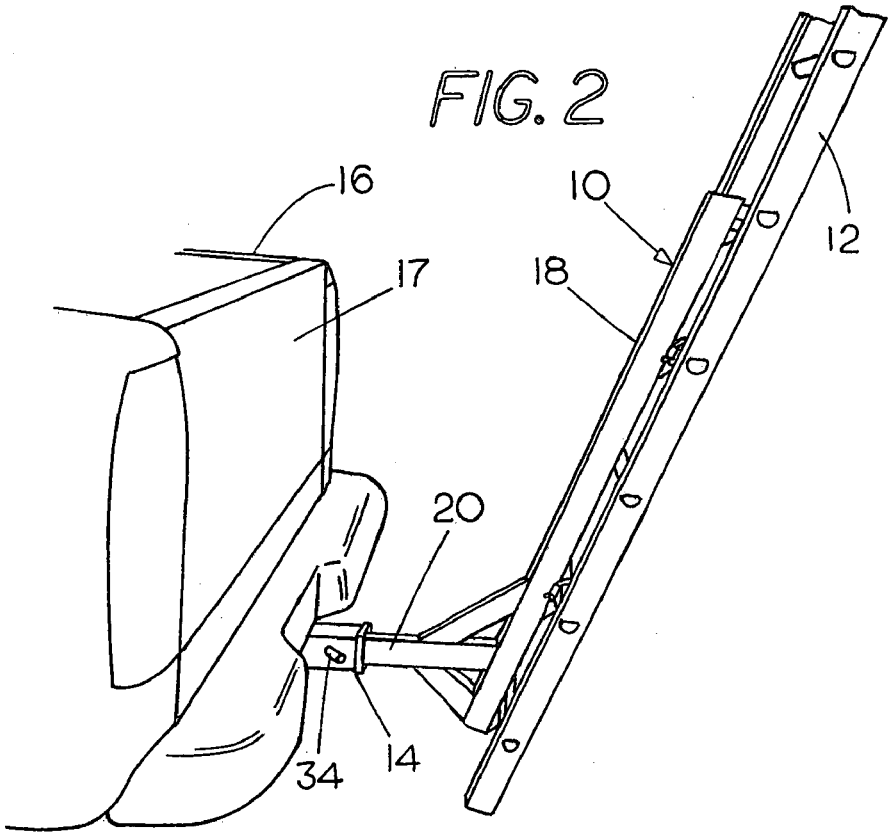
FIG. 2 is a view similar to FIG. 1, showing a ladder mounted on the attachment of the first embodiment.

Referring now to the Drawings, wherein like reference numerals designate like or corresponding elements throughout the views, and particularly referring to FIGS. 1-8, there is shown an attachment 10 for mounting a ladder 12 on the hitch 14 of a vehicle 16. The attachment 10 is not adapted merely for transporting or carrying a ladder to/from a job site on vehicle 16, as are the carriers of the prior art, although it could be used that way if desired. Rather, when attached to the hitch 14 on vehicle 16, the attachment 10 provides a secure and stable base for someone using the ladder, without the expense of an aerial ladder or cherry picker. As will be explained more fully hereinafter, attachment 10 has many advantages over the prior art.

Figure 3:
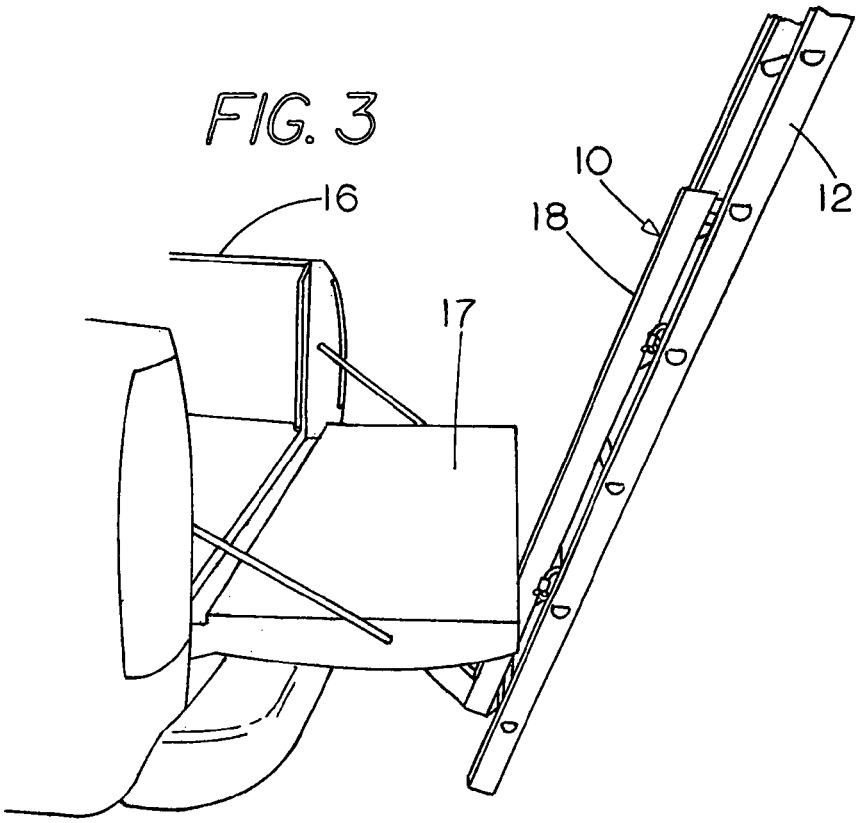
FIG. 3 is a view similar to FIG. 2, with the gate of the pick-up truck open.
Figure 4:
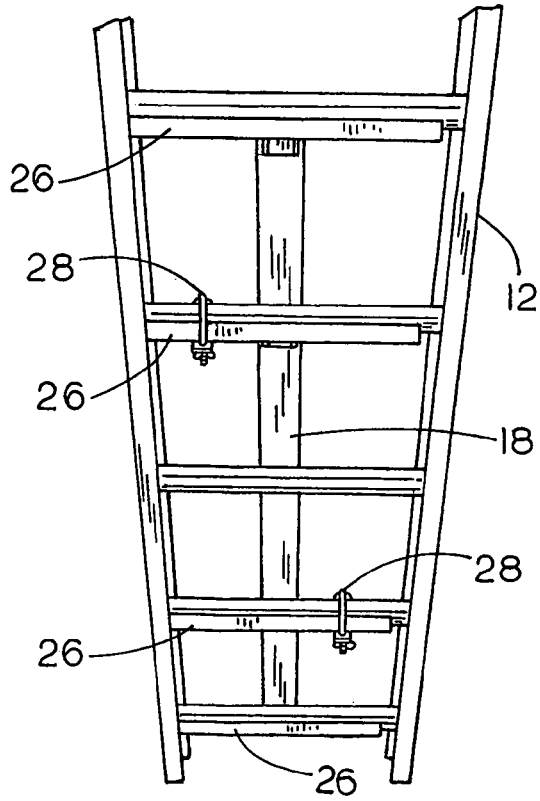
FIG. 4 is an end view of the ladder attachment of the first embodiment, with a ladder mounted thereon.
Figure 5:
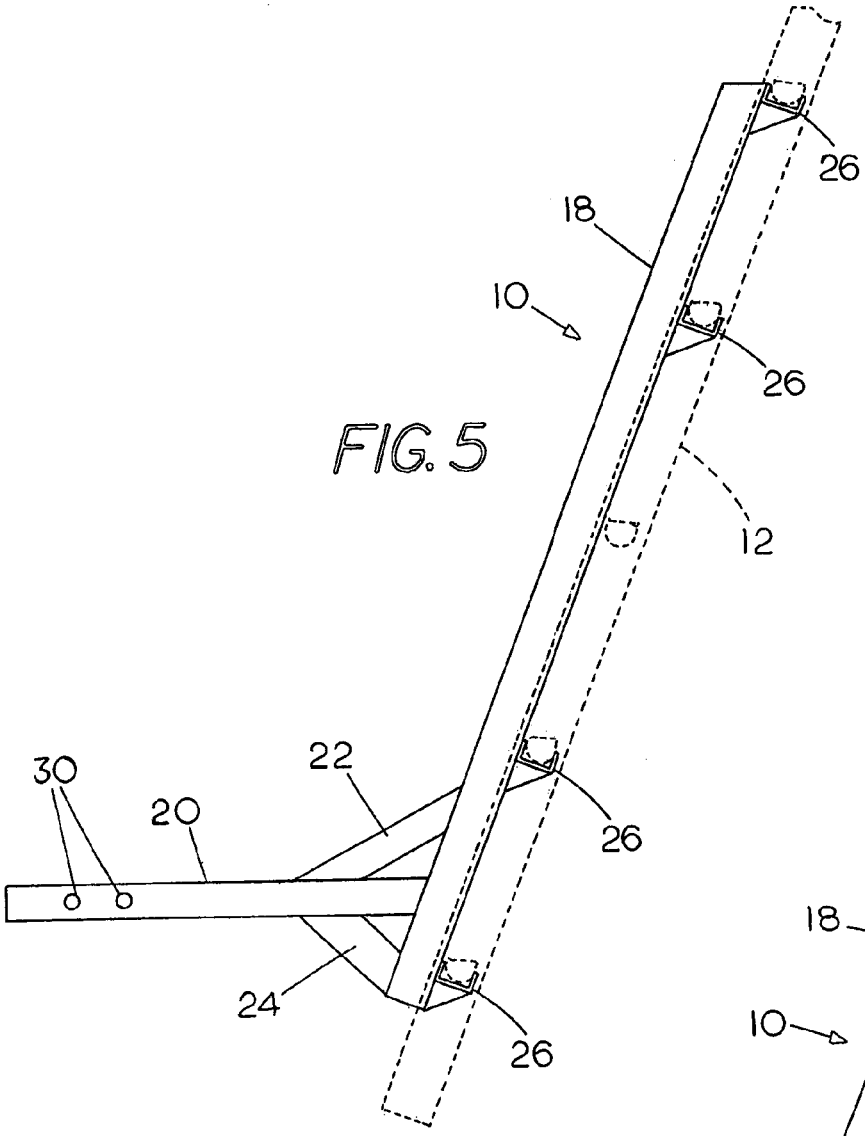
FIG. 5 is a side view of the ladder attachment of the first embodiment, with the ladder and rungs shown in phantom lines.
Figure 6:
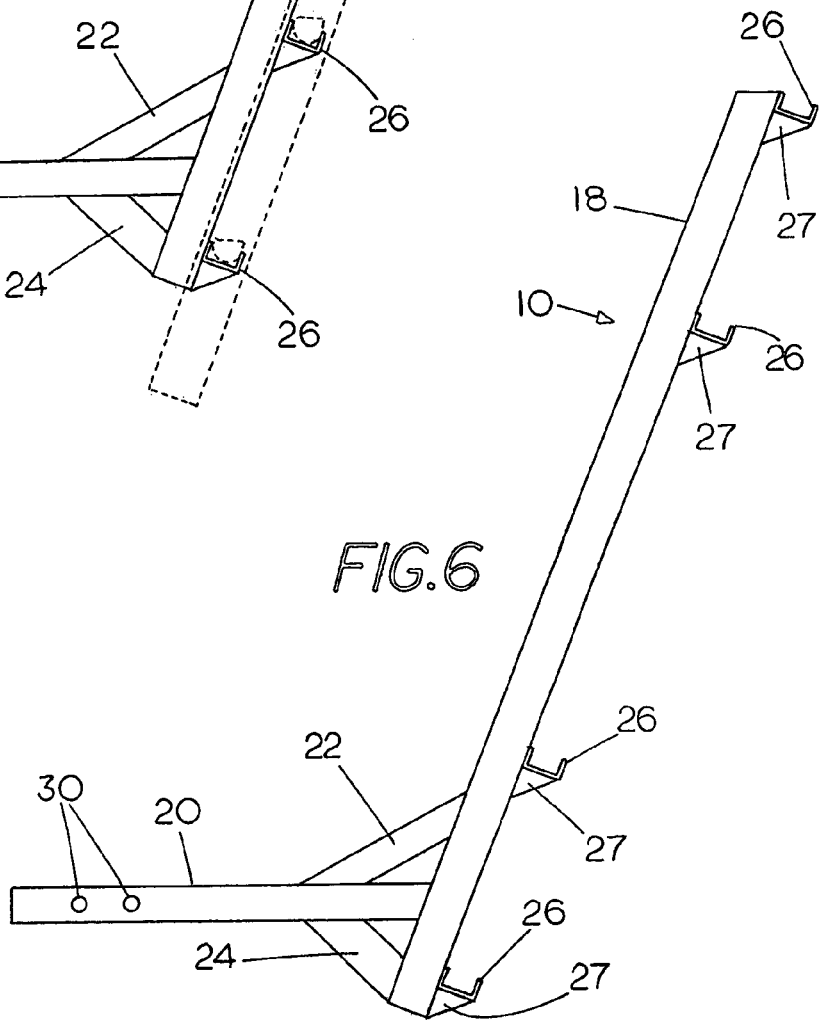
FIG. 6 is a view similar to FIG. 5, without the ladder.
Figure 7:
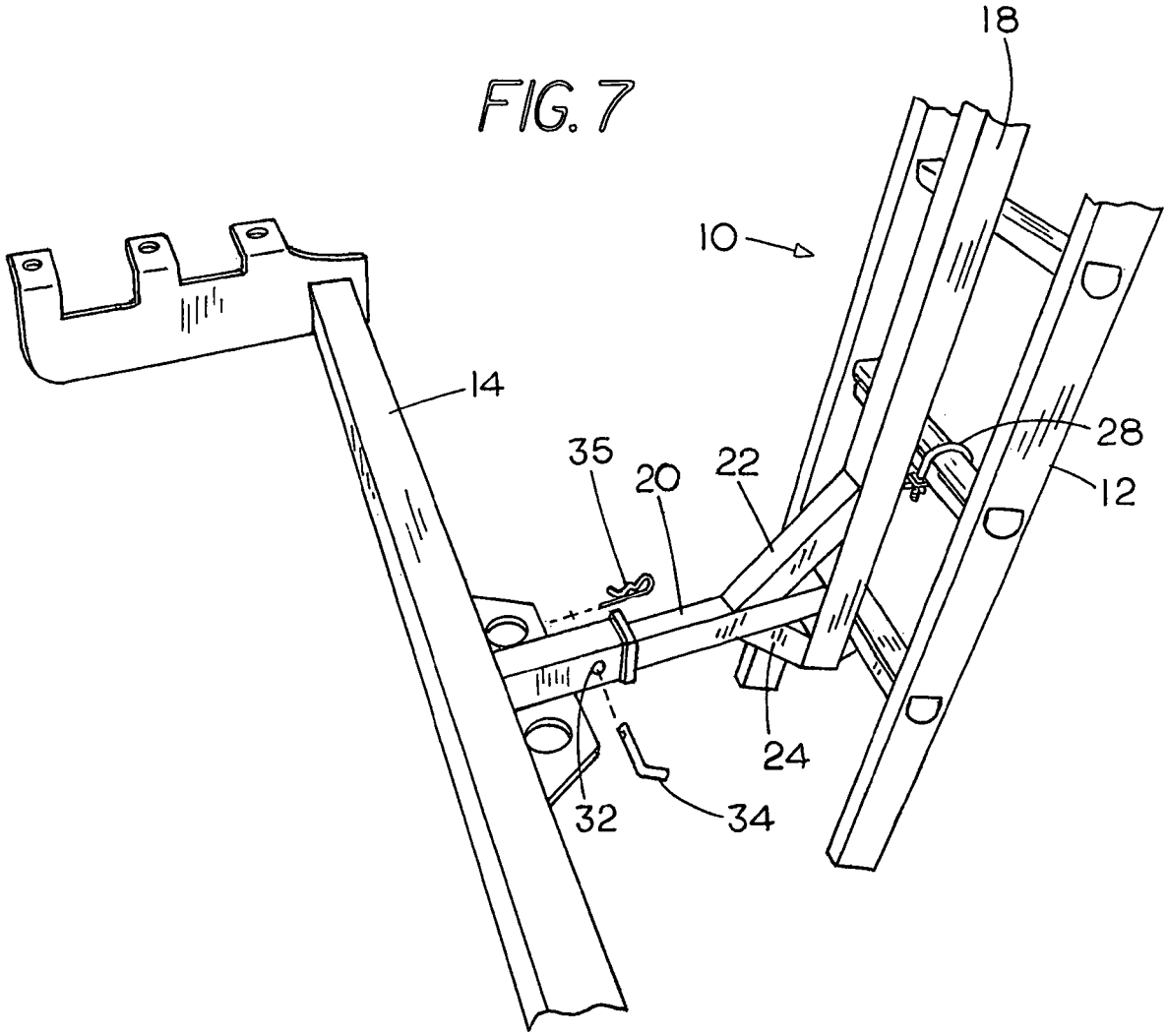
FIG. 7 is an enlarged perspective view of the ladder attachment of the first embodiment secured to the receiver hitch.

The attachment 10 comprises an angled upright frame portion 18 secured to the outer end of a generally horizontal frame portion 20, which portions are preferably co-planar. The upright frame portion 18 may be about four to five feet long, for example. The lower frame portion 20 can be about two feet long, for example, for clearance with the tail gate of vehicle 16 as shown in FIG. 3. Upper and lower braces 22 and 24 are preferably secured between the frame portions 18 and 20 as shown, for reinforcement. Furthermore, as can be seen most easily in FIG. 1 and FIGS. 5-11, the lowermost crosspiece 26 secured to upright frame portion 18 is positioned at an elevation lower than that of horizontally extending frame portion 20 extending from hitch 14. Thus, when the bottommost rung of a ladder 12 is attached to lowermost crosspiece 26, it becomes placed in a position lower than hitch 14. Also, as can be seen most easily in FIGS. 8-11, crosspieces 26 are secured to the surface of upright frame portion 18 positioned remotely from horizontally extending frame portion 20, with one crosspiece 26 positioned close to the top end of upright frame portion 18, one crosspiece 26 positioned close to the bottom end of upright frame portion 18, two crosspieces 26 supporting adjacent rungs on ladder 12, and two adjacently-positioned crosspieces 26 supporting of non-adjacent rungs on ladder 12.

In the preferred embodiment, the frame portions 18 and 20 of attachment 10 are constructed from straight sections of tubular steel, such as two inch square tube stock, although any suitable material can be used. The reinforcing braces 22 and 24 can also be constructed from such tubular material, or they can be fashioned in the form of gussets from flat stock, welded together.

The included obtuse angle between frame portions 18 and 20 of attachment 10 is somewhat more than 90 degrees or a right angle, but substantially less than 180 degrees, in order to provide a comfortable angle of inclination for the user of ladder 12 mounted thereon. In the preferred embodiment, the angle between frame portions 18 and 20 is about 110 degrees, or about 20 degrees off vertical, plus or minus about five (5) degrees.

The attachment 10 further includes a plurality of crosspieces 26 secured in spaced-apart relationship along the upright frame portion 18, opposite frame portion 20. The preferred embodiment of attachment 10 has two pairs of such crosspieces, the lower pair of which are adapted to receive a pair of rungs at the lower end of ladder 12, and the upper pair of which are adapted to receive another pair of rungs further up the ladder. The crosspieces 26 of each pair are preferably centered on the upright portion 18, mutually spaced apart about 12 inches or one foot, which is the standard spacing between ladder rungs. If desired, as few as one pair of cross pieces 26, spaced further apart, such as 36 inches or three feet, could be used. Each crosspiece 26 is about eleven inches long, or somewhat less than the typical length of the rungs in ladder 12 so that the ladder 12 will be evenly centered and balanced on the attachment 10.

The crosspieces 26 are preferably formed from steel channel stock. If desired, gussets 27 can be used for reinforcement.

Figure 8:
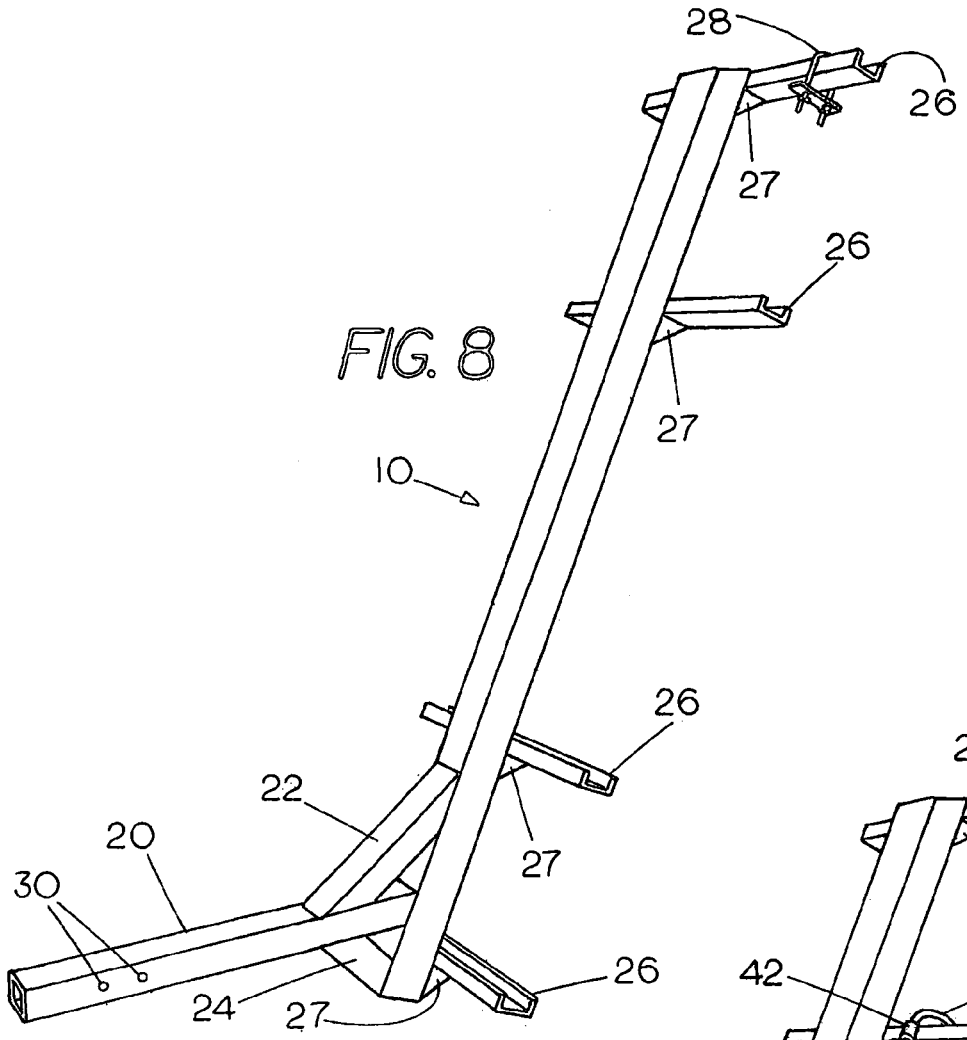
FIG. 8 is a perspective view of the ladder attachment of the first embodiment.
Figure 9:
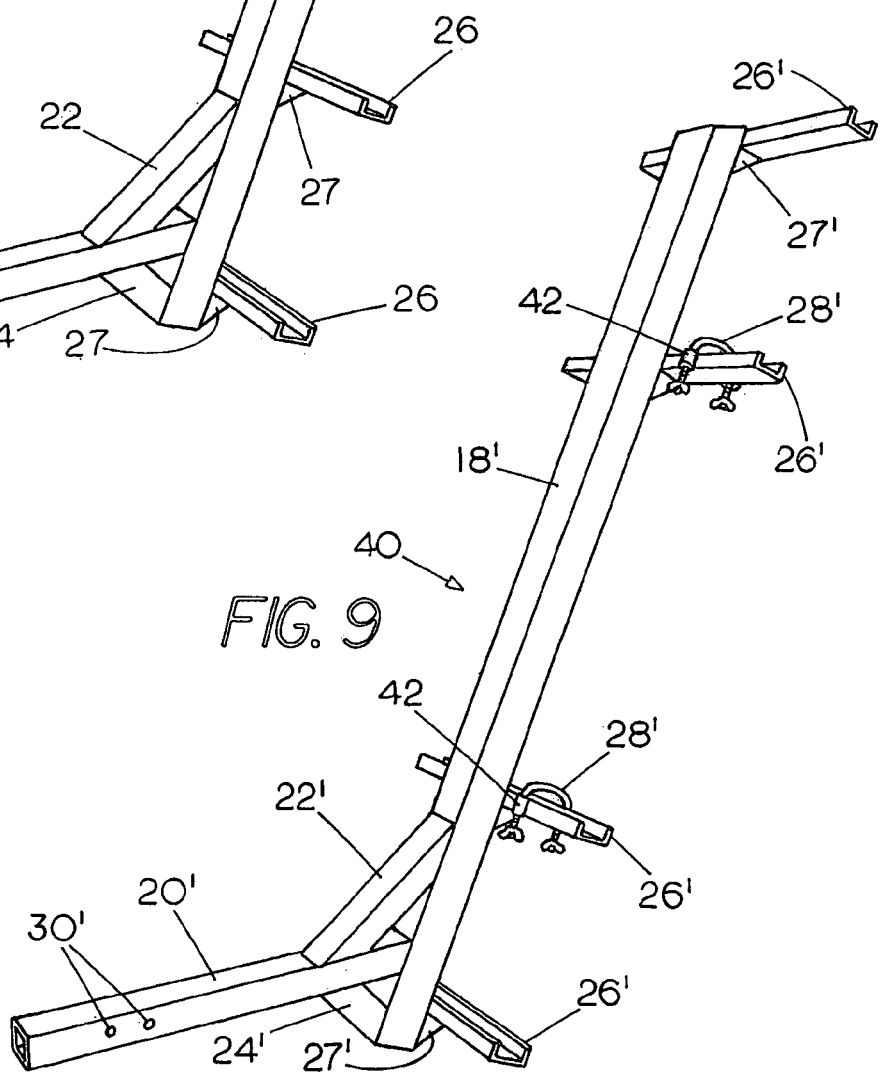
FIG. 9 is a perspective view way of a ladder attachment incorporating a second embodiment of the invention.
Figure 10:
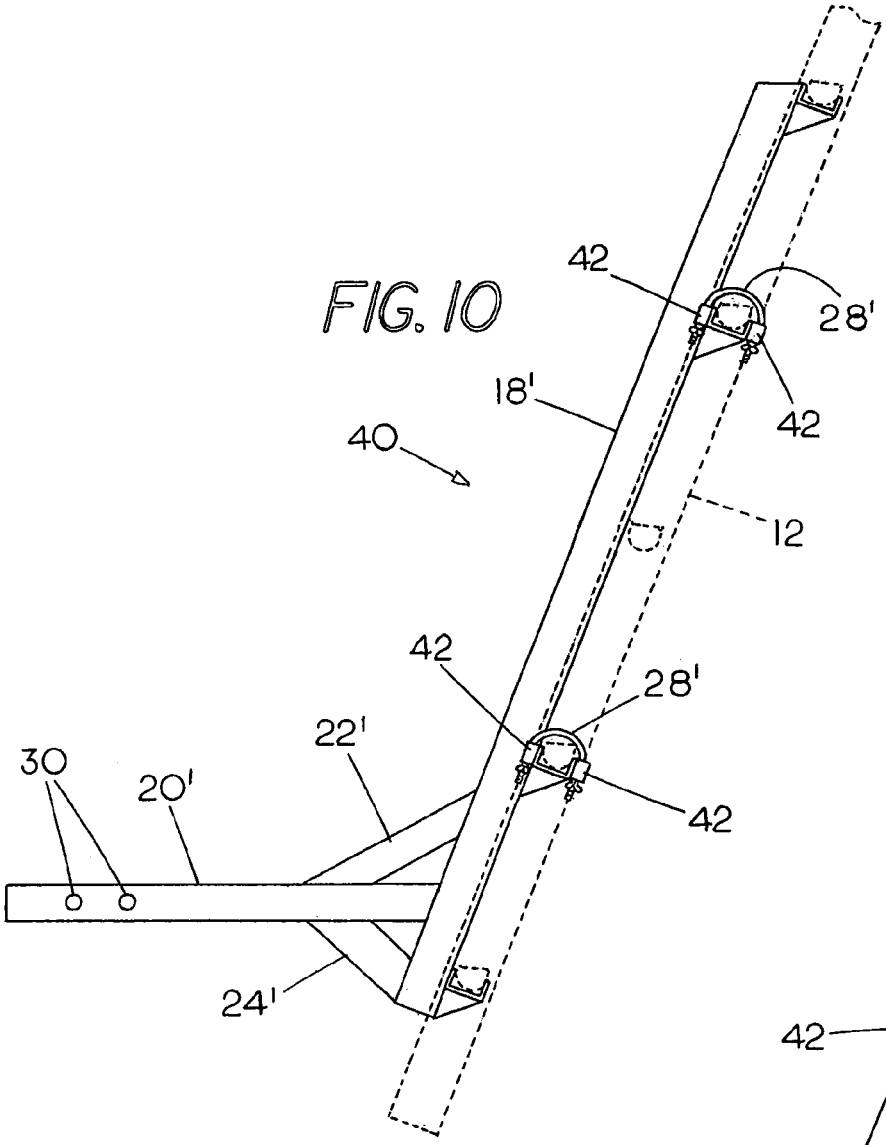
FIG. 10 is a side view of the ladder attachment of the second embodiment, with the ladder and rungs shown in phantom lines.
Figure 11:
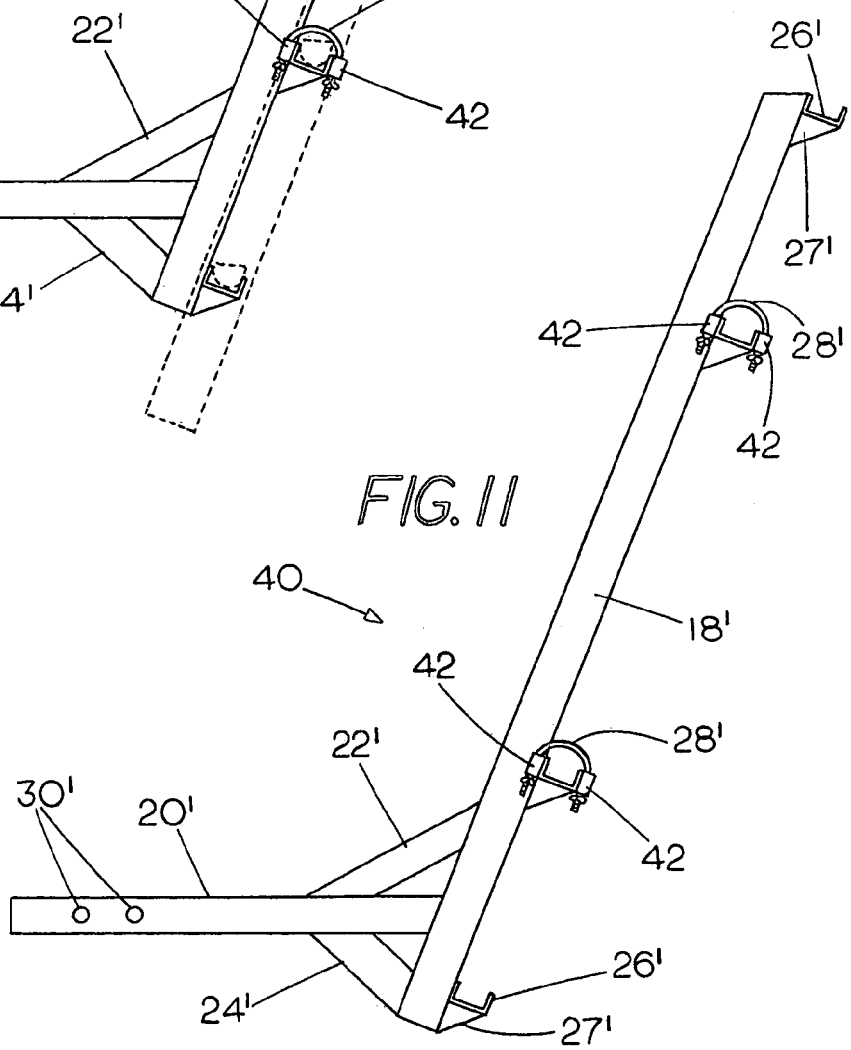
FIG. 11 is a side view of the ladder attachment of the second embodiment, without the ladder.
Figure 12:
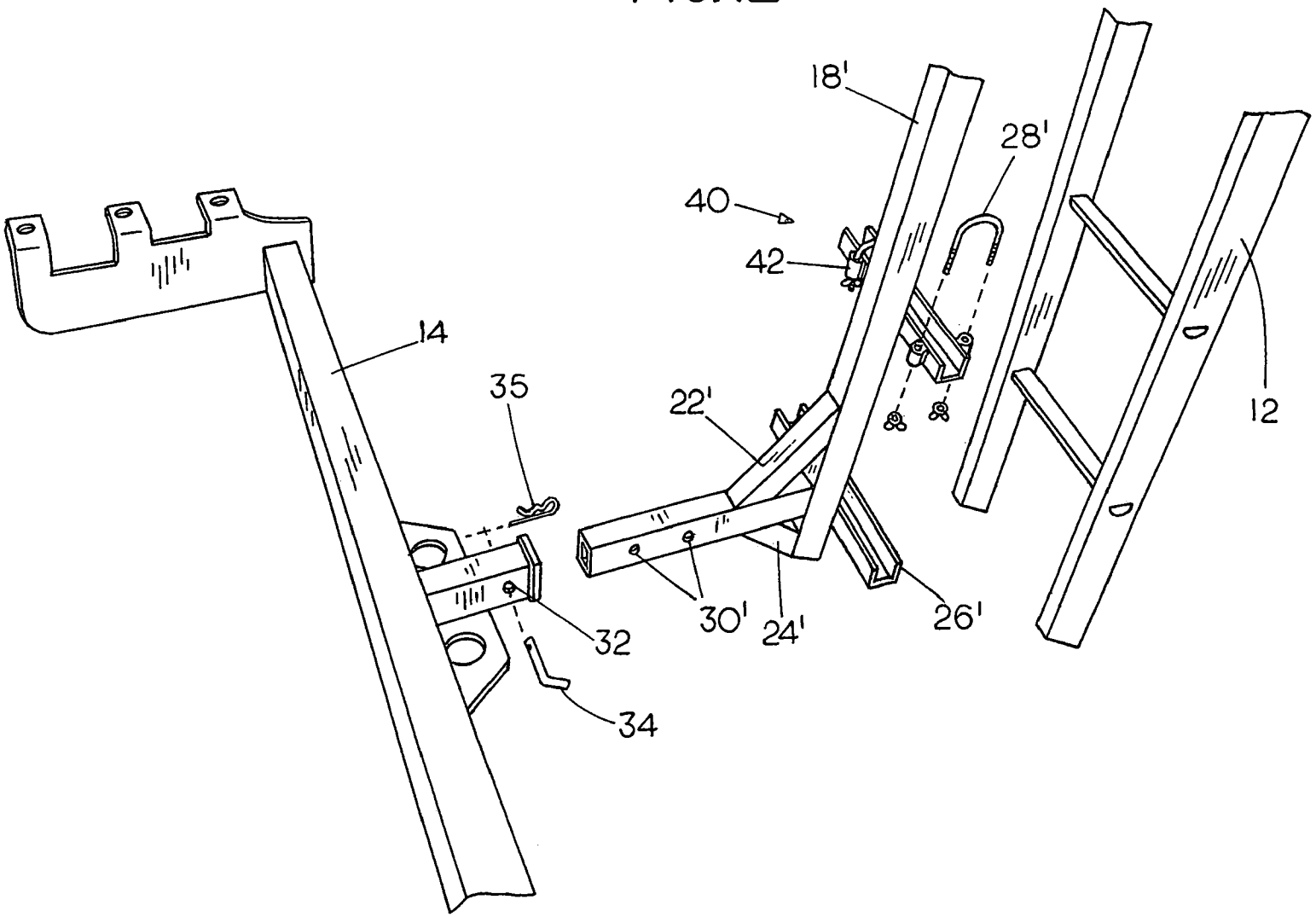
FIG. 12 is an exploded perspective view of the ladder attachment of the second embodiment secured to a receiver hitch.

The ladder 12 is removably secured to attachment 10 by means of U bolts 28 and associated cross plates and nuts, as best seen in FIG. 8. In the preferred embodiment, at least two U bolts 28 and associated cross plates and nuts are provided, one set for each of the uppermost and lowermost crosspieces 26 and associated rungs of ladder 10. Other suitable connectors could also be used, if desired.

As shown, the horizontal portion 18 of attachment 10 is adapted to mate with the hitch 14 on the vehicle 16. In the preferred embodiment, the hitch 14 is a receiver-type hitch secured underneath to the frame at the rear of vehicle 16. Such receiver-type hitches are commercially available from various manufacturers, such as Rigid Hitch of Burnsville, Minn., for example. At least one pair of transverse holes 30 are provided in the frame portion 20 for alignment with corresponding holes 32 in hitch 14, which holes receive a removable clevis or hitch pin 34, with a retaining clip 35 on its end, in order to releasably secure attachment 10 to hitch 14 on vehicle 16. Hitch 14 preferably comprises a Class III through Class V receiver-type hitch.

Referring now to FIGS. 9-12, there is shown a ladder attachment 40 incorporating a second embodiment of the invention. Since attachment 40 incorporates several components or features that are similar to those of attachment 10 of the first embodiment, those have been identified with the same reference numerals, but with prime (') notations for differentiation.

The primary difference between the embodiments is that the attachment 40 incorporates short tubes 42 on the cross pieces 26' so that the U bolts 28' and associated wing nuts are captured and thus, not as apt to be misplaced, as with attachment 10.

Figure 13:
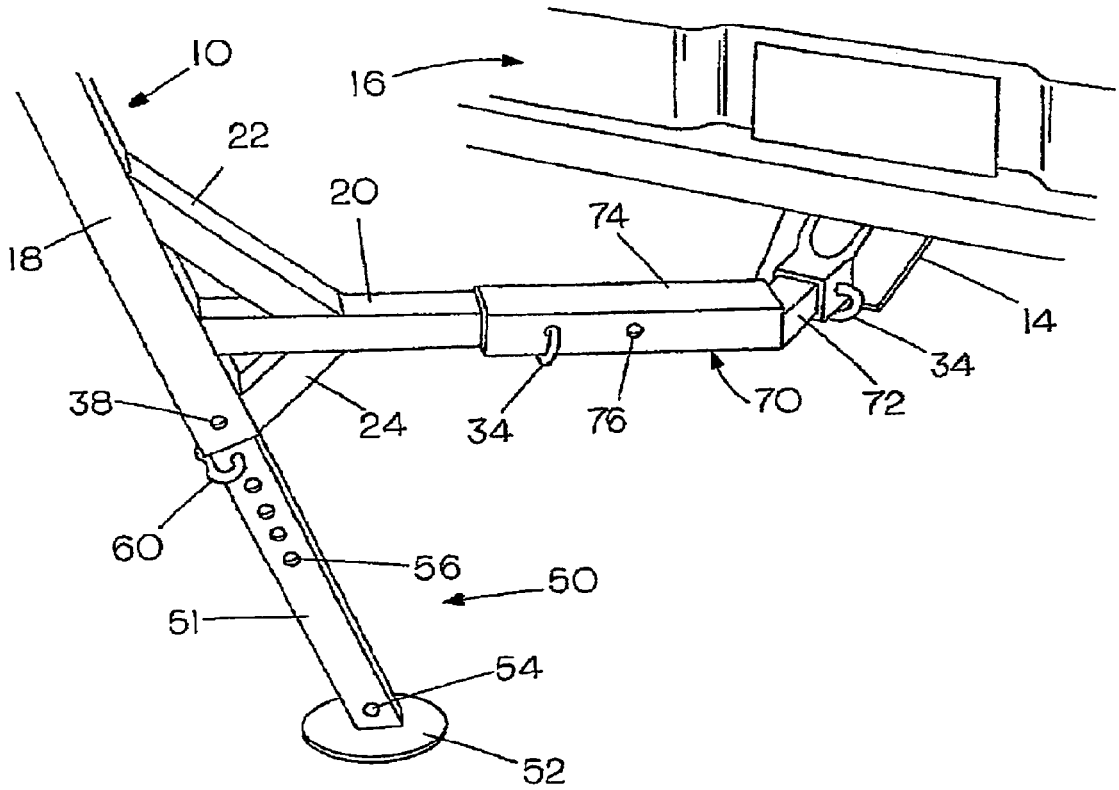
FIG. 13 is an illustration of an optional adjustable leg and an optional offset arm, which can be used with the ladder attachment herein.

FIG. 13 shows two optional accessories that can be used with ladder attachment 10 or 40 of the invention. If additional vertical support is desired, an adjustable leg 50 can be used. Leg 50 has a foot 52 coupled to its lower end at pivot 54. The upper end of leg 50 includes transverse adjustment holes 56 for alignment with a hole 38 provided near the lower end of frame portion 18 or 18', and then connection with a clevis or pin 60.

Also referring to FIG. 13, an offset arm 70 can be used for more flexibility in placement of ladder 12. The arm 70 includes opposite end portions 72 and 74, which are preferably coplanar, connected between attachment 10 or 40 and hitch 14. The outer portion 74 of arm 70 includes transverse holes 76 and is adapted to receive the frame portion 20 or 20' and be connected with a clevis or pin like pin 34. The inner portion 72 of arm 70 has a transverse hole (not shown) and is similarly adapted for receipt and connection with hitch 14 with a clevis or pin like pin 34. The obtuse included angle between portions 72 and 74 of arm 70 is preferably about 135 degrees so that ladder 12 can be positioned about 45 degrees left or right off the centerline of vehicle 16.

From the foregoing, it will be appreciated that the present invention comprises a ladder attachment having several advantages over the prior art. The ladder attachment herein is of inexpensive, straightforward construction. It provides extra flexibility with hitches and ladders already used by many homeowners and contractors. Although illustrated herein for use with a rear hitch, it can just as well be used with a front hitch on a vehicle, such as a pick up truck as shown or a sport utility vehicle, for even more versatility. Other advantages will be evident to those skilled in the art.

Although particular embodiments of the invention have been illustrated in the accompanying Drawings and described in the foregoing Detailed Description, it will be understood that the invention is not limited only to the embodiments disclosed, but is intended to embrace any alternatives; equivalents, modifications and/or rearrangements of elements falling within the scope of the invention as defined by the following Claims.

What is claimed is:

1. A ladder attachment apparatus in combination with a vehicular hitch and a portable ladder to provide a secure and stable base for someone using the ladder, said ladder attachment apparatus comprising:

a generally L-shaped frame;

said frame having a vertically extending upright frame portion and a lower horizontally extending frame portion, said frame portions together defining a predetermined obtuse angle therebetween more than 90 degrees but substantially less that 180 degrees, said upright frame portion having a front surface in contact with said lower frame portion and an opposed rear surface, said lower frame portion being configured for connection to the vehicular hitch;

said frame also having a plurality of crosspieces secured in mutually spaced apart relationship to said rear surface of said upright frame portion so that one of said crosspieces becomes a lowermost crosspiece, said crosspieces each configured to receive a rung of the portable ladder thereon, and said lowermost crosspiece positioned to have a vertical elevation less than that of said lower frame portion;

means for releasably securing said frame to the vehicular hitch; and means for releasably securing the portable ladder to said crosspieces of said upper frame portion wherein the portable ladder becomes secured to said rear surface of said upright member in a position remote from the vehicular hitch.

2. The attachment apparatus of claim 1, wherein said upper and lower portions of said frame are substantially coplanar.

3. The attachment apparatus according to claim 2, wherein said upper portion of said frame is relatively longer than said lower portion of said frame.

4. The attachment apparatus of claim 1, wherein said angle between said upper and lower portions of said frame is in the range of about 105 degrees to about 115 degrees.

5. The attachment apparatus of claim 1, wherein said angle between said upper and lower portions of said frame is about 110 degrees.

6. The attachment apparatus of claim 1, wherein said upper and lower portions of said frame comprise square tubular sections.

7. The attachment apparatus of claim 1, wherein said crosspieces of said frame comprise channel sections.

8. The attachment apparatus of claim 1, wherein said means for releasably securing said frame to the hitch comprises a pin inserted through aligned holes in said horizontally extending member of lower frame portion and the hitch, and said means for releasably securing said frame to the hitch further comprises a removable retainer clip engaging said pin in a manner that prevents accidental withdrawal of said pin.

9. The attachment apparatus of claim 1, wherein said means for releasably securing the ladder to said crosspieces of said frame comprises a plurality of U bolts and associated nuts threadedly secured thereto.

10. The attachment apparatus of claim 1, further including:

an extension leg slidably secured to said frame; and means for releasably securing said extension leg to said frame for additional vertical support.

11. The attachment apparatus of claim 1, further including:

an extension arm slidably connected between said lower portion of said frame and the hitch, said arm including opposite offset ends that allow said frame to become positioned to the left or right of the centerline of the hitch; and means for releasably securing one of said ends of said extension arm to said frame.

12. The ladder attachment of claim 1 further comprising a gusset reinforcing each said crosspiece.

13. The attachment apparatus of claim 1, further including upper and lower braces secured between said horizontally extending member of said lower frame portion and said upright member of said upper frame portion, with said lower brace secured to said bottom end of said upright member.

14. A ladder attachment apparatus in combination with a vehicular hitch and a portable ladder to provide a secure and stable base for someone using the ladder, said ladder attachment apparatus comprising:

a generally L-shaped, substantially coplanar frame having a vertically extending upright frame portion and a lower horizontally extending frame portion, said frame portions together defining a predetermined obtuse angle therebetween ranging between about 105 and about 115 degrees, said upright frame portion having a front surface in contact with said lower frame portion and an opposed rear surface, said lower frame portion being configured for connection to the vehicular hitch;

said frame also having a plurality of crosspieces secured in mutually spaced apart relationship to said rear surface of said upright frame portion so that one of said crosspieces becomes a lowermost crosspiece, said crosspieces also each configured to receive a rung of the portable ladder thereon, and said lowermost crosspiece positioned to have a vertical elevation less than that of said lower frame portion;

means for releasably securing said frame to the vehicular hitch; and means for releasably securing the portable ladder to said crosspieces of said upper frame portion wherein the portable ladder becomes secured to said rear surface of said upright member in a position remote from the vehicular hitch.

15. The attachment apparatus according to claim 14, wherein said upper portion of said frame is relatively longer than said lower portion of said frame.

16. The ladder attachment of claim 14, wherein said crosspieces of said frame are hollow and comprise channel sections.

17. The attachment apparatus of claim 14, wherein said means for releasably securing said frame to the hitch comprises a pin inserted through aligned holes in said horizontally extending member of said lower frame portion and the hitch, and said means for releasably securing said frame to the hitch further comprises a removable retainer clip engaging said pin in a manner that prevents accidental withdrawal of said pin.

18. A ladder attachment apparatus in combination with a vehicular hitch and a portable ladder to provide a secure and stable base for someone using the ladder, said ladder attachment apparatus comprising:

a generally L-shaped, substantially coplanar frame having a vertically extending upright frame portion and a lower horizontally extending frame portion, said frame portions together defining a predetermined obtuse angle therebetween ranging between about 105 and about 115 degrees, said upright frame portion having a front surface in contact with said lower frame portion and an opposed rear surface, said lower frame portion being configured for connection to the vehicular hitch, said upright member also being relatively longer than said lower portion of said frame;

said frame also having a plurality of crosspieces secured in mutually spaced apart relationship to said rear surface of said upright frame portion so that one of said crosspieces becomes a lowermost crosspiece, said crosspieces also each configured to receive a rung of the portable ladder thereon, and said lowermost crosspiece positioned to have a vertical elevation less than that of said lower frame portion;

means for releasably securing said frame to the vehicular hitch; and means for releasably securing the portable ladder to said crosspieces of said upper frame portion wherein the portable ladder becomes secured to said rear surface of said upright member in a position remote from the vehicular hitch.

19. The attachment apparatus of claim 18, further including:

an extension leg slidably secured to said frame; and means for releasably securing said extension leg to said frame for additional vertical support.

20. The attachment apparatus of claim 18, further including:

an extension arm slidably connected between said lower portion of said frame and the hitch, said arm including opposite offset ends that allow said frame to become positioned to the left or right of the centerline of the vehicle; and means for releasably securing one of said ends of said extension arm to said frame.

21. The attachment apparatus of claim 20, wherein said opposite offset ends are substantially coplanar.

* * * * *